United States Patent [19]

Stern, deceased et al.

[11] 3,989,620

[45] Nov. 2, 1976

[54] ROTARY DISTRIBUTOR PLATE FOR A CENTRIFUGAL AIR CLASSIFIER

[75] Inventors: Julius Heinrich Johannes Stern, deceased, late of Dortmund-Hochsten, Germany, by Erika Stern, heir; Werner Strauss, Bochum-Dahlhausen; Albert Kohlmann, Bochum, both of Germany

[73] Assignee: Klockner-Humboldt-Deutz Aktiengesellschaft, Cologne, Germany

[22] Filed: Mar. 3, 1975

[21] Appl. No.: 554,774

[30] Foreign Application Priority Data

Feb. 2, 1974 Germany ..... 2405122

[52] U.S. Cl. ..... 209/148; 209/139 A; 416/186 R

[51] Int. Cl.[2] ..... B07B 7/083

[58] Field of Search ..... 209/139 A, 145, 148, 209/150; 261/88, 89; 34/59; 222/410; 198/128; 416/186; 302/60, 61; 239/224, 223; 241/275; 159/4 S

[56] References Cited

UNITED STATES PATENTS

| | | | |
|---|---|---|---|
| 1,759,629 | 5/1930 | Riley | 239/223 |
| 2,707,314 | 5/1955 | Horth | 241/275 X |
| 3,346,192 | 10/1967 | Hege | 239/223 |
| 3,369,647 | 2/1968 | Van Der Lely | 198/128 |

FOREIGN PATENTS OR APPLICATIONS

| | | | |
|---|---|---|---|
| 267,845 | 12/1913 | Germany | 209/139 A |
| 229,178 | 2/1925 | United Kingdom | 159/4 S |

*Primary Examiner*—Frank W. Lutter
*Assistant Examiner*—Ralph J. Hill
*Attorney, Agent, or Firm*—Herbert L. Lerner

[57] ABSTRACT

Rotary distributor plate for distributing particles of solid or liquid material in a centrifugal-type classifier includes a plate-like member having an upper surface, and means carried by the surface for uniformly throwing off from the plate-like member particles of material fed thereto.

6 Claims, 3 Drawing Figures

ROTARY DISTRIBUTOR PLATE FOR A CENTRIFUGAL AIR CLASSIFIER

The invention relates to a rotary distributor plate for an air classifier of the centrifugal type and, more particularly, for such an air classifier having an out-of-center or eccentric feed of granular, pulverulent or other particulate materials.

The increasing demands for mechanical processing or treatment of fine-granular to dust-like material with the aid of air classifiers more and more require the suitable adjustment or adaptation of the installed classifier. Especially during operation at only part of the maximum feed rate delivery which is the usual or normal operation, difficulties as to uniform distribution of the material arise that result from the only partial use of the feed cross section of the feed lines which is designed to provide maximum feed rate.

With the heretofore generally known smooth distributor plates, which might be provided with acceleration strips at the outer edges thereof, difficulties were encountered during an unavoidably eccentric feeding a partial load resulting from a material flow in the feed tube that was not completely filled by the outwardly flowing material, the difficulties being caused by the subsequent nonuniform stressing or loading of the sizing chamber by the non-uniformly thrown-off particulate material.

If the feed stream or flow does not strike the distributing plate in the center thereof, then, in the impingement sector or in a sector shifted or displaced by a given angle, the supplied material is preferably thrown off, so that this classifier sector assumes the essential part of the separating or classifying operation, while the sector located opposite the inpingement sector is less used or drawn upon for the separating or classifying operation.

The measures provided heretofore for eliminating these difficulties, such as one disclosed, for example, in U.S. Pat. No. 1,358,375, wherein the distributing plate is furnished at the periphery thereof with a multiplicity of uniformly distributed, radially outwardly extending ribs, or wherein a perforated band lying around the periphery of the distributing plate is provided, do not eliminate the foregoing defects when the feed to the distributing plate is out-of-center or eccentric thereto. Through the measures or features disclosed in the aforementioned U.S. patent, on the contrary, an acceleration of the throw-off is attained due to the more rapid adjustment or matching of the delivered material to the peripheral velocity of the distributing plate and thus also the throw-off is forced directly subsequent to the feeding in the feed sector.

It is accordingly an object of the invention of the instant application to provide a distributor plate for an air classifier of the centrifugal type which avoids the foregoing disadvantages of the heretofore known devices of this general type that oppose the current relatively high processing or treatment demands, and improve the function of centrifugal air classifiers or the like.

Every non-uniform throw-off in the classifier impairs the sizing or classifying operation in a manner that the too-rapidly thrown off feed material in the respective throw-off sector is comminuted by the impact thereof upon the wall of the sizing chamber, and that additionally, due to the high impact velocity in the respective throw-off sector, the material adheres to the wall of the sizing chamber and causes a change in the air guidance, so that the efficiency of the classifier is considerably impaired.

In addition thereto, there is also a corresponding change in the classifying air flow through the higher portion of the material in the throw-off sector, which effects a preferred flow-through of the remaining part of the sizing chamber which is largely free of material being classified or sized. Thus, a further impairment of the classifier efficiency is produced.

It is accordingly a further object of the invention to provide an air classifier distributor plate which effects uniform throw-off of the material being classified and, accordingly, affords a sizing or classifying operation with maximal efficiency.

With the foregoing and other objects in view, there is provided, in accordance with the invention, a rotary distributor plate for distributing particles of solid or liquid material in a centrifugal-type classifier, comprising a plate-like member having an upper surface, and means carried by the surface for uniformly throwing off from the plate-like member particles of material fed thereto.

A result of this construction is that even in the case where material to be classified is fed eccentrically to the rotary distributor plate, it is no longer possible to effect an unhindered, one-sided throw-off of the material in the feed sector. In contrast thereto, the material is retarded or delayed as well as evened out in the movement thereof toward the throw-off edge of the distributor plate, so that a uniform distribution of the material fed to the distributor plate is effected over the entire surface of the classifier.

In accordance with another feature of the invention, the rotary distributor plate comprises a plate-like member formed with an outer edge and has a ring-shaped feed zone onto which the particles of material are fed, the uniformly throwing-off means tangentially engaging the ring-shaped feed zone and extending therefrom to the outer edge of the plate-like member. The ring-shaped construction of the feed zone necessarily results from the rotary motion of the distributor plate. An advantageous consequence thereof is that the material that would otherwise be thrown off immediately in the feed sector is retarded or delayed on the path of travel thereof to the outer edge of the distributor plate, is moved along throw-off retarding strips to the edge of the distributor plate and, along this path, during several rotations of the distributor plate, is slowly distributed over the entire classifier surface.

In accordance with a further feature of the invention, therefore, the throwing-off means comprise an elongated strip having a rectangular or square profile or also a triangular profile. The advantage of such a construction is that an economical normal profile member produced by rolling or pulling, preferably of steel, can be readily introduced by welding or threaded fastening as the uniformly throwing-off means. An angular or triangular profile can also perform a collection or capturing function especially for readily bouncing or elastic feed material.

In accordance with an additonal feature of the invention, part of the elongated throw-off strip extends from the location at which it is in tangential engagement with the ring-shaped feed zone, partly around the latter. An advantageous consequence of this feature is that the material applied to the feed zone cannot be flung aside uncontrolled, for the most part, due to the falling or gravity energy and due to the rebounding or impact energy thereof, whereby it would then fall downwardly with insufficient velocity through the distributor over the edge of the distributor plate in the throw-off sector, but rather it is retained in the middle of the feed zone and then slowly distributed by the retarding strips. Simultaneously, through this feature of the invention, limits or boundaries to the feed zone are produced.

In accordance with yet another feature of the invention, the throwing-off means comprise two elongated strips, each tangentially engaging the ring-shaped feed zone at mutually spaced-apart locations, and extending from those locations to respectively different locations at the outer edge of the plate-like member. With this use of two throw-off retarding strips, the distributing action is achieved at minimal expense.

In accordance with a concomitant feature of the invention, the plate-like member has a ring-shaped feed zone onto which the particles of material are fed, the feed zone being at least partly located in a funnel-shaped recess formed in the plate-like member. Because the initial rebound or impact energy of the granular pulverulent or drop-like material is directed on the distributor plate toward the middle of the funnel-shaped recess, a further improvement of the throw-off retarding action is produced, which serves to provide an especially uniform feed of the material applied to the throw-off retarding strips and accordingly provides a further improvement in the classifier operation.

Other features which are considered as characteristic for the invention are set forth in the appended claims.

Although the invention is illustrated and described herein as rotary distributor plate for a centrifugal air classifier, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing, in which.

Figure 1:
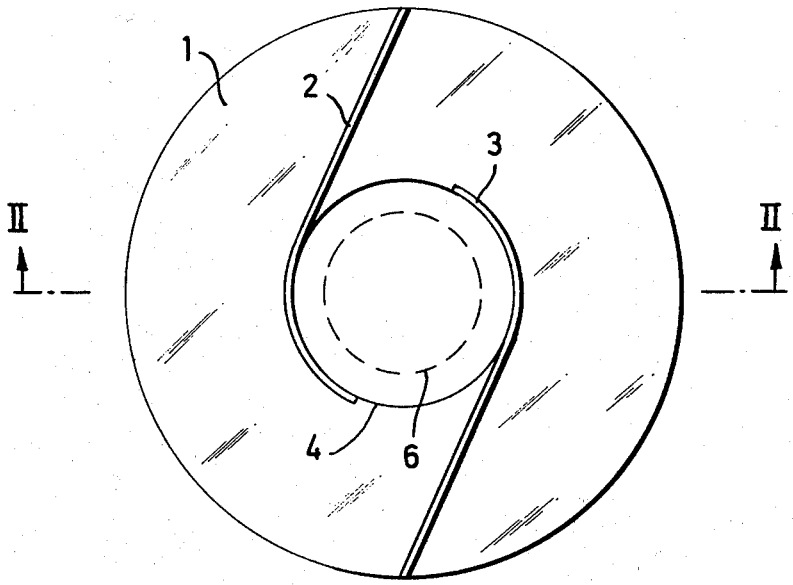
FIG. 1 is a diagrammatic top plan view of a rotary distributor plate for a centrifugal air classifier which is provided with throw-off retarding strips in accordance with the invention.

Referring now to the drawing, there is shown in FIG. 1 a rotary distributor plate 1 according to the invention for use in an otherwise conventional centrifugal air classifier, the surface of the distributor plate 1 being subdivided by two throw-off retarding strips 2 which are disposed tangentially to a ring-shaped feed zone located between coaxial inner and outer circles 4 and 6 into which particulate material which is to be sized by the centrifugal air classifier is fed through a conventional supply opening located eccentric to the distributor plate in the classifier housing. The two throw-off retarding strips 2 extend outwardly from the peripheral edge of the feed zone between the circles 4 and 6 to the edge of the distributor plate 1. As shown in FIG. 1, beginning with the point at which the strips 2 meet the circle 4 which defines the outer limit of the feed zone, they are provided with an arcuate shape coinciding with an overlying part of the circle 4.

Figure 2:
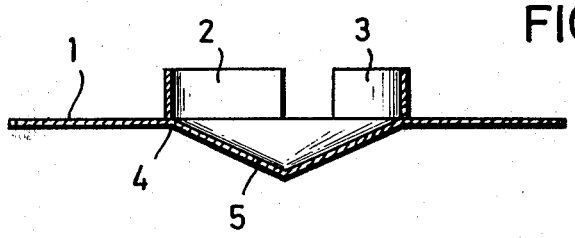
FIG. 2 is a cross-sectional view of FIG. 1 taken along the line II—II in the direction of the arrows.

From the sectional view of the rotary distributor plate 1 in FIG. 2, it is clearly shown that the plate 1 is formed with a funnel-shaped depression 5 in the middle thereof, which serves to increase or intensify the throw-off retarding effect. The funnel-shaped depression 5 is partly surrounded by the arcuate portions of the throw-off retarding strips 2.

The operation of the rotary distributor plate 1 is as follows:

When a stream of particulate material impinges on the eccentric or off-center impingement or feed zone, for example located between the line 4 of the circle defining the outer limit of the feed zone and the line 6 of the circle defining the inner limit of the feed stream during rotation of the distributor plate 1, the material spread over the impingement sector, which is always formed at the same location of the sizing chamber, would always be flung or thrown off into the corresponding sector of the classifier, if no throw-off retarding strips were provided on the distributor plate. This is prevented, however, by providing the throw-off retarding strips 2; at every rotation of the distributor plate, the inpinging material is caught by the throw-off retarding strips 2, slides slowly along the throw-off retarding strips to the outside, during the further rotation of the distributor plate 1, and is thus distributed uniformly over the entire surface of the classifier. In addition, this effect is increased or intensified due to the funnel-shaped construction of the distributor plate 1 in the feed zone thereof, because a further accumulation of the material which is directed toward the middle of the distributor plate 1 occurs in the feed zone funnel. The inclination of the funnel wall is such that, due to the action of centrifugal force, the material to be classified slowly travels upwardly along the funnel wall and thereby distributes uniformly over the sizing chamber.

In the invention of the instant application, two throw-off retarding strips 2 are preferably employed. When only one throw-off retarding strip is provided, the sector kept free for the unhindered throw-off is often too large so that the curved part of the strip has to be extended farther through an arc of substantially 270° about the outer radius of the feed zone in order to reduce the size of the free sector. When more than two throw-off strips are used, an acceleration function is produced as occurs with classifiers constructed in accordance with the present state of the art.

The aforedescribed embodiment of the invention is not limited only to the distribution of granular or pulverulent materials, but is also employable for distributing droplet-shaped i.e. liquid particles, or similarly shaped materials. The shape or form of the throw-off retarding strips can be accommodated, within the scope of the invention, to the particular field of use; thus, for example, the rectilinear outer part of the throw-off retarding strip may often be advantageously curved where desirable or necessary.

Figure 3:
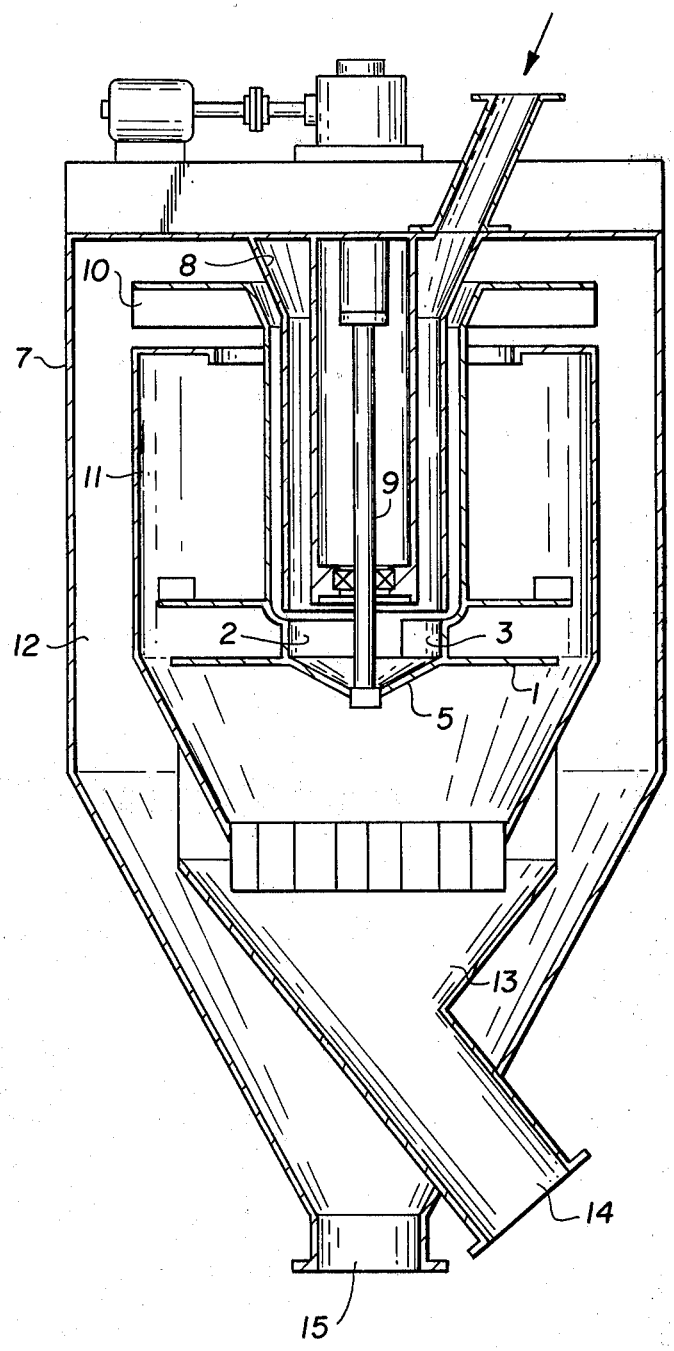
FIG. 3 is an elevational view, partly in section, of an air classifier having a rotary distributor plate according to the invention.

FIG. 3, there is shown an air classifier employing a rotary distributor plate 1 according to the invention. The air classifier is provided with a housing 7 having an eccentric supply hopper 8 extending downwardly to a location above the rotary distributor plate 1, which is rotatable by a drive shaft 9 that is driven by a suitable drive transmission located at the top of the classifier housing 7. A ventilating fan wheel 10 is suitably mounted on the distributor plate 1, for example, as shown in FIG. 3, so as to be rotatable therewith. A sizing chamber 11 is disposed within the classifier housing 7 and is spaced therefrom so as to define a fine-particle separating chamber 12 coaxially surrounding the sizing chamber 11. The fan wheel 10 is located in the upper part of the fine-particle separating chamber 12 above an opening at the top of the sizing chamber 11, providing communication between the latter and the fine-particle separating chamber 12.

The operation of the air classifier is as follows. Particulate material is supplied in the direction of the arrow at the top of FIG. 3 through the hopper 8 eccentrically onto the rotary distributor plate 3 and is flung thereby, guided by the retarding strips 2, in radial direction into the sizing chamber 11, the coarser particles thereby falling into a collecting chamber 13 and being discharged through an outlet 14. Due to the suction created by the rotating ventilating fan wheel 8, the fine-particle fraction of the material located in the sizing chamber 11 is withdrawn from the opening at the top of the sizing chamber 11 and blown into the fine-particle separator chamber 12. The fines are accordingly flung by centrifugal forces against the inner surface of the classifier housing 7, slide downwardly along the surface and discharge through an outlet 15 at the bottom of the classifier.

It is claimed:

1. Rotary distributor plate for distributing particles of solid or liquid material in a centrifugal-type classifier comrising a plate-like member having an upper surface, an outer edge, and an inner ring-shaped feed zone onto which partiles of material are fed; and means projecting from said surface for outwardly guiding and throwing off from said plate-like member particles of material fed to said inner-ring shaped zone, said throwing-off means having an inner portion tangentially engaging and contiguous with said ring-shaped feed zone and an outer portion extending therefrom to said outer edge of said plate-like member.

2. Rotary distributor plate according to claim 1 wherein said plate-like member has a funnel-shaped particle collecting recess formed in a central area of said plate-like member, said ring-shaped feed zone being located around the outer portion of said funnel-shaped recess.

3. Rotary distributor plate according to claim 1 wherein said throwing-off means comprises an elongated particle retarding strip extending upwardly and outwardly along said upper surface of said plate-like member.

4. Rotary distributor plate according to claim 3 wherein said strip has a substantially rectangular profile.

5. Rotary distributor plate according to claim 3 wherein the inner portion of said strip extends from the location at which it is in tangential engagement with said ring-shaped feed zone, partly around the circumference of the latter.

6. Rotary distributor plate according to claim 3 wherein said throwing-off means comprises two elongated strips, each having an inner portion tangentially engaging said ring-shaped feed zone at mutually spaced-apart locations, and extending from said locations to respectively different locations at the outer edge of said plate-like member.

* * * * *